US007867016B2

(12) United States Patent
Nabilek et al.

(10) Patent No.: US 7,867,016 B2
(45) Date of Patent: Jan. 11, 2011

(54) ELECTRICAL PRESS-IN CONTACT

(75) Inventors: János Nabilek, Bicske (HU); Ralf Ehler, Budapest (HU)

(73) Assignee: Vincotech Holdings S.A.R.L., Lexembourg (LU)

( * ) Notice: Subject to any disclaimer, the term of this patent is extended or adjusted under 35 U.S.C. 154(b) by 0 days.

(21) Appl. No.: 12/362,588

(22) Filed: Jan. 30, 2009

(65) Prior Publication Data

US 2009/0197439 A1 Aug. 6, 2009

(30) Foreign Application Priority Data

Feb. 2, 2008 (DE) ..... 10 2008 007 310

(51) Int. Cl.
*H01R 13/58* (2006.01)

(52) U.S. Cl. ..... 439/474; 439/82

(58) Field of Classification Search ..... 439/82, 439/474, 751, 943

See application file for complete search history.

(56) References Cited

U.S. PATENT DOCUMENTS

| | | | | |
|---|---|---|---|---|
| 4,678,262 | A | 7/1987 | Reichardt et al. | |
| 4,995,816 | A * | 2/1991 | Grabbe | 439/71 |
| 5,306,169 | A | 4/1994 | Fukushima et al. | |
| 6,155,856 | A | 12/2000 | Sanada | |
| 6,511,336 | B1 | 1/2003 | Turek et al. | |
| 6,733,318 | B2 | 5/2004 | Myer et al. | |
| 6,997,727 | B1 | 2/2006 | Legrady et al. | |
| 7,018,246 | B2 * | 3/2006 | Raistrick et al. | 439/751 |
| 7,125,260 | B2 | 10/2006 | Orita et al. | |
| 2004/0067698 | A1 | 4/2004 | Lee | |

FOREIGN PATENT DOCUMENTS

| | | |
|---|---|---|
| DE | 3416968 | 11/1985 |
| DE | 19752210 | 5/1999 |
| DE | 202005014070 | 11/2005 |
| DE | 102004050715 | 3/2006 |

* cited by examiner

*Primary Examiner*—Tho D Ta
(74) *Attorney, Agent, or Firm*—Michael Best & Friedrich LLP

(57) ABSTRACT

The present invention relates to an electrical press-in contact, particularly press-in pin contact, for transmitting electric current and/or electrical signals, comprising a press-in section and a mounting section which are mechanically coupled with each other via a relief section, and the relief section comprises a compensating portion and a stop portion, wherein the compensating portion allows a coupled relative movement of the press-in section and the mounting section, and the stop portion blocks a movement of press-in section and mounting section towards each other. Furthermore, the present invention relates to an electrical or electronic module or a printed circuit board comprising an electrical press-in contact according to the invention.

20 Claims, 5 Drawing Sheets

ELECTRICAL PRESS-IN CONTACT

The present invention relates to an electrical press-in contact, particularly a press-in pin con-tact, for transmitting electric current and/or electrical signals. Furthermore, the present invention relates to an electrical or electronic module or a printed circuit board comprising an electrical press-in contact according to the invention.

Electrical contact elements for electrically contacting carriers, for example printed circuit boards, which are designed as press-in contacts, are known in the electrical and electronic fields. Press-in contacts serve to establish solderless electrical connections, which are referred to as so-called press-in connections. An electrical contact between the press-in con-tact and the carrier is established in the press-in connection by introducing a pin of the press-in contact into a bore of the carrier, the bore having a smaller diameter than the pin. The inside of the bore is here copper-plated or additionally tin-plated, whereby mechanical fixing and electrical contacting are simultaneously accomplished by pressing the pin into the bore.

Electrical press-in contacts of modules for printed circuit boards for the electrical connection thereof are a known alternative to the comparatively expensive solder connections. Standard press-in contacts for press-in connections on printed circuit boards, however, must be fixed directly behind the press-in zone by means of a plastic housing of the module to avoid excessive mechanical loads on an electrical contacting of the press-in contact within the module, especially when compensating bends or other relief zones, for instance for thermal loads on the press-in contact, are present on the press-in contact. This is e.g. accomplished through a corresponding encapsulation of the press-in contact with a housing section or by means of a projection on the press-in contact directly behind the press-in section thereof.

U.S. Pat. No. 6,997,727 B1 discloses an electrical contact element for the mutual electrical contacting of two printed circuit boards. The contact element comprises two flat and directly adjacent legs, with each leg having an inwardly open, rectangular, deformable section, which are off-set relative to each other in the contact element. These rectangular frames formed in the respective leg enable the contact element to withstand a mechanical load arising between two interconnected printed circuit boards. Furthermore, the open rectangular sections minimize a capillary action due to the two adjacent legs, for a liquid solder.

U.S. Pat. No. 6,155,856 discloses an electrical contact element for a printed circuit board, and an arrangement of the contact element on the printed circuit board and a housing. The contact element comprises a spiral or s-shaped relief section so that thermal elongations have no excessive impact on an electrical contacting of the printed circuit board. The arrangement of contact element, printed circuit board and housing is here configured such that the contact element is soldered with the printed circuit board, this electrical contacting is followed by the relief section, and subsequently the contact element is firmly connected to the housing. Due to the firm connection of the contact element to the housing, plug-in forces acting on the contact element projecting out of the housing can be intercepted and kept away from the contact point with the printed circuit board and from the relief section.

US 2004/0106327 A1 discloses an integral electrical connection sleeve for two electrical pin contacts that are insertable from opposite sides into the connection sleeve. To permit a certain relative movement between the two pin contacts in the state where they are plugged together with the connection sleeve, the connection sleeve is partly slotted circumferentially and fully slotted longitudinally. On account of the structural weakening of the connection sleeve, a certain movability of its two longitudinal end sections relative to each other is accomplished.

U.S. Pat. No. 6,511,336 B1 discloses a flexible mounting for a motor mountable on a printed circuit board, the mounting simultaneously establishing an electrical contacting of the motor with the printed circuit board. An electrical connection of the motor with the mounting is established via a solderless clamp connection.

Furthermore, U.S. Pat. Nos. 5,306,169, 6,733,318 B2 and 7,125,260 B2 disclose electrical connectors for printed circuit boards, wherein one or a plurality of electrical contact elements of the connector are configured to be movable within a range.

In case press-in contacts of modules, e.g. power supply modules, are not to be integrated into a housing wall of the modules or are not to be fastened with said wall, or a corresponding housing section is to be omitted altogether, but are to be soldered directly onto a corresponding carrier, e.g. a ceramic one, special measures are needed for suppressing excessive tensile forces acting on a fastening of the press-in contact with the carrier (solder connection) on the one hand and for preventing compressive forces from acting on a longitudinal compensation provided on/in the press-in contact on the other hand. Without such measures the longitudinal compensation needed for the press-in contact would collapse upon pressing in of the press-in contact, and in the long run the solder and press-in connection of the press-in contact in the module or the printed circuit board would get damaged.

It is an object of the present invention to provide an improved electrical press-in contact, particularly an improved press-in pin contact, and an electrical or electronic module or a printed circuit board with an electrical press-in contact according to the invention. It should here be possible according to the invention to replace conventional solder contacts with relief section by a press-in contact with relief section according to the invention. Furthermore, it should be possible according to the invention to dispense with a fastening or locking and blocking, respectively, of a press-in contact with relief section on a housing, or to omit a corresponding housing section altogether. Moreover, it is an object of the present invention to be able to replace conventional electrical solder contacts by press-in contacts according to the invention without changing a former design of an electrical or electronic module or a printed circuit board.

Attention should be paid that the electrical press-in contact according to the invention comprises a relief section which reliably prevents inadmissibly great forces from arising on the corresponding mechanical and electrical connections (solder connection and/or press-in connections) of the press-in contact and that upon pressing in of a press-in section of the press-in contact the relief section does not collapse. An additional mechanical fixation should here be dispensable, except for the two longitudinal ends of the press-in contact to be contacted electrically. Furthermore, the press-in contact according to the invention should be producible in an efficient way and should be easy to handle.

The object of the invention is achieved by means of an electrical press-in contact, particularly a press-in pin contact, for transmitting electric current and/or electrical signals, according to claim 1, and by means of an electrical or electronic module or a printed circuit board with a press-in contact according to the invention, according to claim 19.

The electrical press-in contact according to the invention comprises a press-in section and a mounting section, preferably formed as a solder or press-in section, which are connected via an inventive relief section of the press-in contact to each other, preferably integrally. According to the invention the relief section comprises a compensating portion which imparts a movement of the press-in section and the mounting section towards and away from each other. Furthermore, the relief section according to the invention comprises a stop portion which prevents an excessive relative movement between press-in section and mounting section.

This means that the stop portion of the relief section according to the invention is configured such that it confines the compensating portion in its maximal path of compression and expansion, respectively, whereby the relative movement of the press-in section relative to the mounting section and the relative movement of the mounting section relative to the press-in section can only take place to a limited degree. According to the invention this prevents damage to the compensation portion caused by the stop portion.

In principle it is possible to configure the stop portion such that the movement of press-in section and mounting section towards and also away from each other can be confined. In preferred embodiments of the invention the stop portion is however configured such that said portion only blocks a movement of press-in section and mounting section in one direction. This preferably takes place when press-in section and mounting section move towards each other.

This means that the stop portion of the electrical press-in contact is arranged on/in the press-in contact such that the movement of press-in section and mounting section towards each other is blocked, starting from a specific position of press-in section relative to the mounting section, and can no longer continue. The mutual movement of the sections towards each other is here blocked in such fashion that the compensating portion cannot get damaged, i.e. cannot be compressed excessively, i.e. compensating bends, S-bends or a spiral of the compensating portion maintain their respective function.

According to the invention a force bypass prevents damage, particularly the collapsing of the relief section and the compensating portion, respectively, of the electrical press-in contact. This force bypass limits an excessive deformation of the press-in contact in press-in direction, but allows a preferably free deformation in a direction opposite the press-in direction. According to the invention inadmissibly great tensile loads on a solder point or a press-in section, respectively, are reliably avoided, but a safe pressing in of the press-in contact is accomplished.

The force bypass of the electrical press-in contact according to the invention can be accomplished through various constructional measures. It is in principle possible to configure the relief section such that the compensating portion thereof and the stop portion thereof are arranged in parallel or in series with each other. Here the compensating portion and the stop portion of the press-in contact may be arranged directly next to each other or also further apart from each other on/in the press-in contact. Attention must just be paid that the compensating portion and the stop portion are positioned in a press-in force direction between the press-in section and the mounting section.

In preferred embodiments of the invention the stop portion is provided substantially in symmetry with respect to a longitudinal centerline of the press-in section on/in the electrical press-in contact. This means that the stop portion is preferably arranged substantially in symmetry with respect to a force centerline extending through the press-in contact. The force centerline is here formed by the press-in force on the press-in contact, particularly the press-in section thereof, and results from a pressing in of the press-in contact into a carrier.

In embodiments of the invention the electrical press-in contact comprises two cooperating stops for blocking the movement of press-in section and mounting section towards each other. Here a stop is provided on a part of the stop portion at the press-in section side and the other stop is provided on a part of the stop portion at the mounting section side. If a compressive force is exerted between the press-in section and the mounting section, the two stops will move towards each other unless they are already positioned on one another, thereby getting into mutual contact, whereby they stop the movement of the press-in section and the mounting section towards each other. In case the two stops rest on each other, the mounting section can be pressed into a corresponding contacting opening of the carrier. The force needed for this is preferably introduced from the mounting section via the two stops into the press-in section.

In embodiments of the invention the two stops may contact each other or may be spaced apart from each other through a slot or a gap in an inoperative position of the electrical press-in contact. With the help of directly adjacent stops a press-in contact is implemented in the case of which only a movement of the press-in section and the mounting section away from each other is first possible. By contrast, if a gap is provided between the two stops, a movement of the press-in section and the mounting section away from and towards each other is possible, and on the other hand a compressed end position of the press-in section with respect to the mounting section can be defined through a size of the slot or gap.

In embodiments of the invention the stop portion of the relief section comprises at least a single shaft or preferably two shafts. The stop at the mounting section side is provided at a free end of the corresponding shaft. The shaft or the shafts of the relief section are preferably arranged substantially in symmetry with respect to the force centerline of the press-in contact. If a single shaft is provided, the compensating portion of the corresponding press-in contact is asymmetrical with respect to the force centerline; by contrast, if two shafts are provided it is possible to additionally arrange also the compensating portion in symmetry with respect to the force centerline. According to the invention the respective compensating portion is substantially provided in parallel, spaced apart by a slot, with the corresponding shaft.

The stop at the press-in section side which cooperates with the corresponding stop at the mounting section side is provided on a shoulder of the relief section. The shoulder is here part of the stop section. Depending on the number of the shafts in the relief section, a corresponding number of shoulders are provided opposite the corresponding shaft in/on the relief section of the electrical press-in contact. For the purpose of finding a conjoint position one or both of the two cooperating stops may comprise a recess in which the corresponding other stop can be accommodated and thus locked to a certain degree. This prevents shaft and shoulder from sliding past each other when the press-in contact is pressed in.

Preferably the shaft or the shafts and the compensating portion pass into the mounting section of the electrical press-in contact. It is here preferred that the corresponding shaft, the compensating portion and the mounting section are integrally interconnected in terms of material. By analogy, the shoulder or the shoulders and the compensating portion pass into the press-in section of the electrical press-in contact. It is here preferred again that the corresponding shoulder and the compensating portion are integrally formed with the press-in section in terms of material. Since the compensating portion in embodiments of the invention is integrally formed in terms of material both with the mounting section and the press-in section, the mounting section and the press-in section are preferably integrally formed in terms of material, resulting in a press-in contact that is integrally formed in terms of material.

In embodiments of the invention in which the compensating portion and the stop portion of the relief section are arranged in series, it is preferred that a compensating web of the compensating portion forms the stop at the press-in section side of the stop portion following the compensating portion. Here one of the preferably larger longitudinal sides of the compensating web forms the stop at the press-in section side. This longitudinal side of the compensating web is positioned preferably directly on the stop at the mounting section side of the electrical press-in contact. Said stop is e.g. a front side of the mounting section.

In such embodiments of the invention the compensating portion substantially comprises the compensating web and possibly the attachments thereof in the direction of the mounting section and the press-in section of the electrical press-in contact. The stop portion of the press-in contact substantially comprises the longitudinal side of the compensating web that forms the stop at the press-in section side, and also the corresponding stop at the mounting section side that is preferably provided on the mounting section.

In the inoperative position of the electrical press-in contact the two stops rest substantially on each other, and the stop portion of the press-in contact is substantially a conjoint area of the compensating web and the mounting section. Here the compensating web preferably lies flat on the mounting section, or with its side forming the stop at the press-in section side in parallel with a front side of the mounting section. At a right angle thereto the press-in section is then provided on the compensating web, optionally with interposition of a transition section. In such an embodiment of the invention the press-in section can be moved away from the mounting section, the stop portion being then additionally provided with a gap between the two stops.

Additional embodiments of the invention become apparent from the other dependent claims.

The invention will now be explained in more detail with reference to embodiments taken in conjunction with the attached drawing, in which:

DETAILED DESCRIPTION

Figure 1:
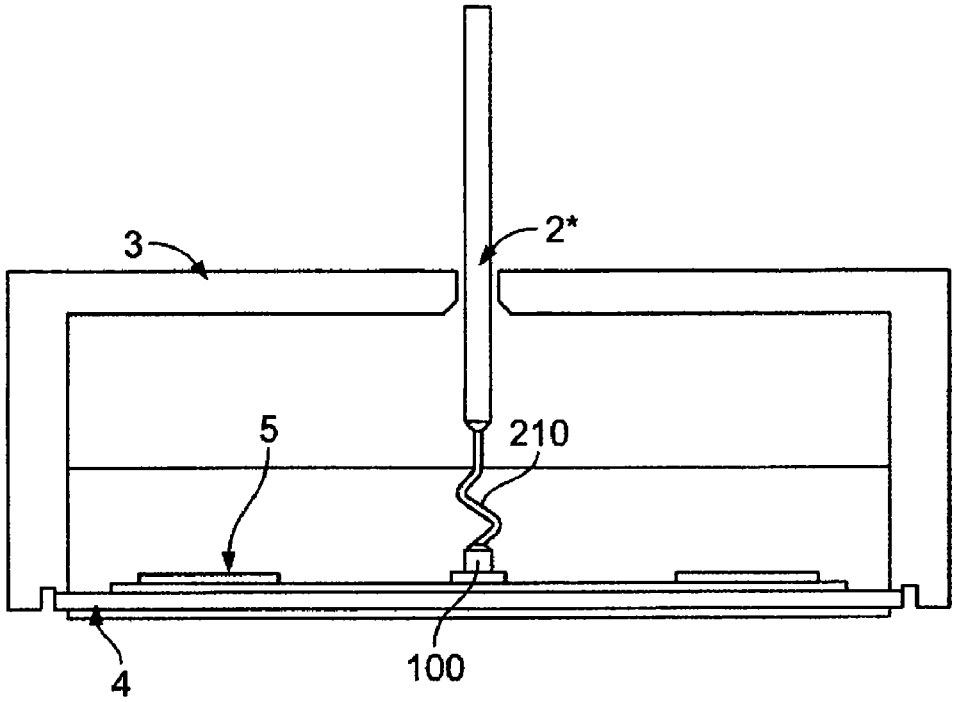
FIG. 1 is a sectional side view showing a module with an electrical solder contact according to the prior art.

The invention will now be explained in more detail hereinafter, starting from a prior art illustrated in FIGS. 1 and 2 ("*" in the drawing designates the prior art), on the basis of four embodiments of an electrical press-in contact for electrical and/or electronic modules. Such modules may e.g. be power supply modules, IGBT modules, transistor modules, diode modules, etc. Furthermore, the invention can be used with press-in contacts for printed circuit boards, such as e.g. SMD printed circuit boards.

The invention, however, shall not be limited to the embodiments shown in FIGS. 3 to 14, but shall refer to all electrical press-in contacts in the case of which the press-in contact comprises a stop portion in addition to a compensating portion for example for thermal expansions, the stop portion confining the compensating portion in its extent of movement.

Here it is especially possible to provide the compensating portion and the stop portion at any desired positions of the press-in contact between its mounting section and its press-in section. It is just important according to the invention that the stop portion should confine the compensating portion in its maximum extent of movement at least in one direction. The question which arrangement of the compensating portion with respect to the stop portion should be chosen depends on the properties desired for the corresponding press-in contact, and the arrangement can be chosen in almost any desired way. Furthermore, according to the invention all compensating portions known in connection with electrical contact elements, particularly press-in and solder contacts, can be used.

Figure 2:
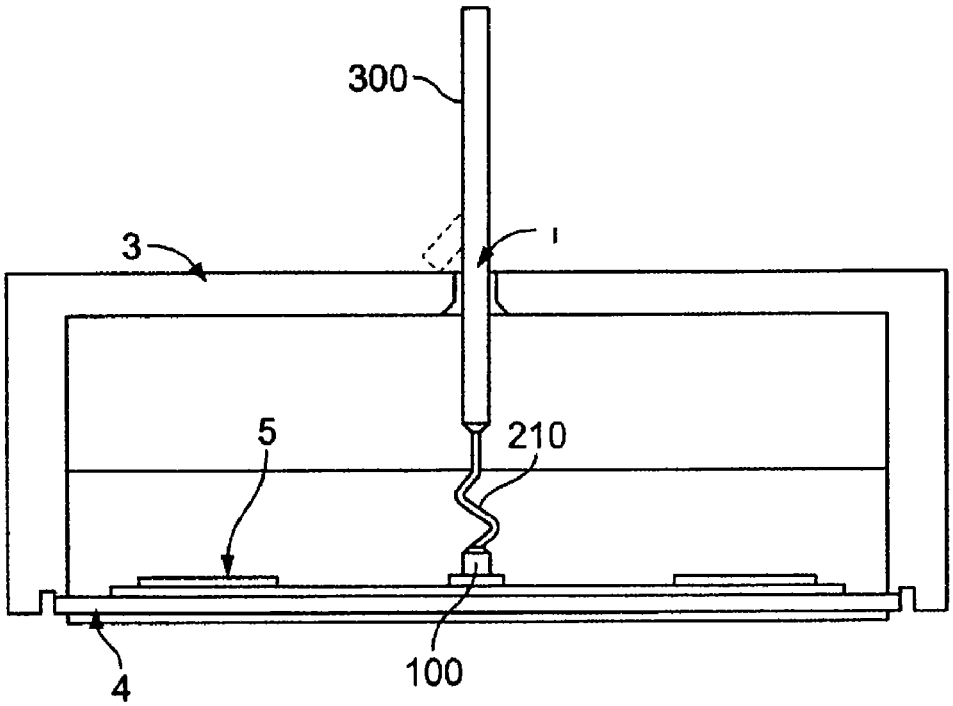
FIG. 2 is a sectional side view showing a module with an electrical press-in contact according to the prior art.

In the electrical and electronic field electrical contact elements 1*, 2* according to the prior art, as are shown in FIGS. 1 and 2, require a compensating portion 210 because of forces arising due to external influences, such as thermal elongations, dimensional tolerances and/or mounting tolerances. This compensating portion 210 prevents inadmissibly great forces from acting on the electrical connections, which can be established with the corresponding contact element 1*, 2*. For instance, FIG. 1 shows an electrical solder contact 2* and FIG. 2 shows an electrical press-in contact 1* for a module according to the prior art.

Nowadays solder contacts 2* are already manufactured with a compensating portion 210 (compensating bends, S-bends) to prevent inadmissibly great forces from acting on the electrical contacts producible therewith. If such solder contact elements 2* were provided with a press-in section 300 (see FIG. 2) instead of a solder section and pressed in, the compensating portion 210 of such a press-in contact 1* would collapse due to the press-in force needed for the press-in section 300 during the press-in operation.

To avoid such a situation, the press-in contacts 1* are locked in the prior art by means of a lock on the housing 3 (projection shown in broken line in FIG. 2), or the housing 3 is directly and firmly connected to a section of the press-in contact 1*, which is shown in FIG. 2, in which the housing 3 is injection-molded onto or around the press-in contact 1*. Locking with the housing 3 requires very narrow tolerances and cannot always be employed without problems due to special mechanical characteristics of the module structure. Furthermore, a section of the housing 3 or even a separate housing 3 is always needed for the locking with the housing 3, which makes the module in question and its housing 3, respectively, complicated in their construction and also expensive.

Furthermore, FIGS. 1 and 2 show the mounting of the respective electrical contact element 1*, 2* on a carrier 4, which comprises an electrical or electronic component 5. To this end the contact element 1*, 2* in question is provided with a mounting section 100, which is e.g. soldered to a conductor of the carrier 4. Furthermore, FIGS. 1 and 2 show that about half the space between the carrier 4 and the housing 3 is filled with silicone gel, with the housing 3 being glued to the carrier 4.

In the four embodiments of the invention as illustrated in the drawing (FIGS. 3 to 14), a corresponding electrical press-in contact 1 according to the invention comprises a mounting or fastening section 100, a relief section 200, a transition section 400, and a press-in section 300. The respective press-in contact 1 is here configured to extend in a longitudinal direction L and is made flat and elongated, which can easily be seen in FIGS. 3, 6, 9 and 12.

The respective sections 100, 200, 400, 300 pass into one another continuously and form a press-in contact which is preferably configured as one piece in terms of material. The press-in contact 1 is preferably formed as a stamping/bending part and consists of an electrically conductive material which preferably exhibits good spring characteristics. The electrical press-in contact 1 according to the invention may be any desired electrical contact element 1 which is e.g. formed as an electrical press-in pin or socket contact.

The mounting section 100 of the respective electrical press-in contact is respectively formed as a solder base in the present embodiments. However, it is also possible to configure a mounting section 100 as a press-in section 300. The relief section 200 serves to compensate for forces arising on the press-in contact 1 and has a compensating or expanding portion 210 which compensates length differences arising between the mounting section 100 and the press-in section 300 opposite the mounting section.

Here the compensating portion 201 may be configured like a compensating portion 210 according to the prior art and comprise, for instance, one or a plurality of compensating bends, S-bends, or a spiral. The relief section 200 and its compensating portion 210, respectively, are followed in the present embodiments by the transition portion 400 and then by the press-in section 300. However, it is also possible according to the invention to omit the transition section 400 or to provide the transition section between the mounting section 100 and the relief section 200.

To prevent a collapsing of the compensating portion 210, for instance when the electrical press-in contact 1 is pressed into a carrier 4, a force bypass is provided according to the invention on the press-in contact 1. Said force bypass limits a deformation of the compensating portion 210, so that the compensating portion 210 cannot get damaged. Preferably, the force bypass confines the deformation of the compensating portion 210 in only one direction, namely the press-in direction (see force arrow F in FIGS. 5, 8, 11 and 14), but allows deformation in the opposite direction.

This means that a free deformation is preferably possible in the direction of tension of the electrical press-in contact 1. According to the invention inadmissibly great tensile loads are avoided on solder points and press-in zones by means of the press-in contact according to the invention. According to the invention press-in contacts 1 with compensating portions 210 can be provided that can be pressed in without projections and without special measures into printed circuit boards or similar carriers. In particular, the invention offers advantages in the use of press-in pin contacts in power supply modules and in other applications, e.g. SMD applications.

Figure 3:
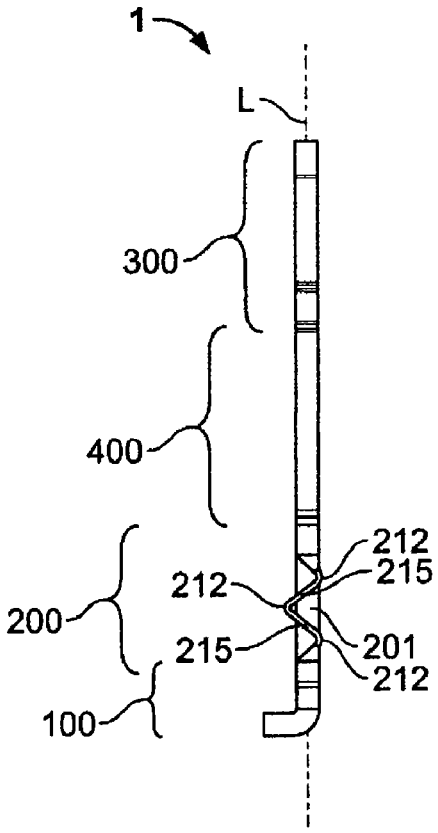
FIG. 3 is a side view showing a first embodiment of an electrical press-in contact according to the invention in its inoperative position.
Figure 4:
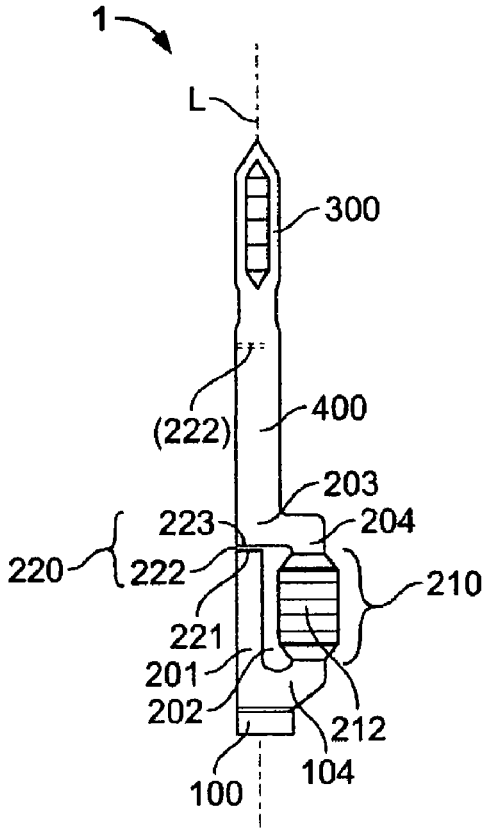
FIG. 4 is a top view on FIG. 3.
Figure 5:
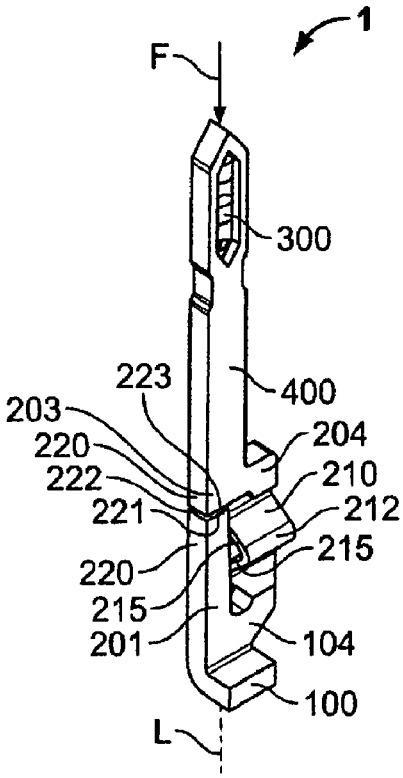
FIG. 5 is a perspective illustration of the first embodiment of the press-in contact according to the invention.

An embodiment of the force bypass according to the invention is shown in FIGS. 3 to 5. Here the relief section 200 of the electrical press-in contact 1 comprises a stop portion 220 next to the compensating portion 210. Compensating portion and stop portion 220 are here provided in parallel and approximately at the same level in the press-in contact 1. It is however possible to shift the compensating portion 220 or the stop portion 220 along the longitudinal direction L of the press-in contact 1, which in FIG. 4 is illustrated by way of a slot (shown in broken line) of the stop portion 220.

The compensating portion 210 is reduced in the present embodiment in comparison with a thickness of the remaining press-in contact 1 (see FIG. 3) and has at least one compensating bend 212 and a compensating web 215. In the present embodiment the compensating portion 210 in the side view shown in FIG. 3 has the shape of two S's arranged one after the other.

The stop portion 220 is formed in the press-in contact 1 in a parallel offset configuration and spaced apart via a recess 202, which can clearly be seen in FIG. 4. The stop portion 220 substantially comprises two stops 221, 223, which are spaced apart from each other via a slot 222. A maximal movement of mounting section 100 and press-in section 300 towards each other is adjustable via a height (extension in longitudinal direction L) of the slot 222.

The one stop 221 of the electrical press-in contact 1 is provided at a side of the press-in contact 1 where the mounting section 100 is also positioned. Inversely, the stop 223 opposite thereto is provided at a side of the press-in contact 1 at which the press-in section 300 is also positioned. The slot 222 positioned between the stop 221 at the mounting section side and the stop 223 at the press-in section side is bridged by the compensating portion 210 of the press-in contact 1, so that the mounting section 100 is preferably integrally connected to the press-in section 300.

The stop 221 at the mounting section side is preferably a free end of a shaft 201 which is provided in the relief section 200 and which extends away from the mounting section 100 in longitudinal direction L. The compensating bend(s) 212 and the compensating web(s) are provided in parallel with said shaft 201. The stop 223 at the press-in section side is preferably provided on a shoulder 203 which is integrally connected to the press-in section 300. In the present embodiment the shoulder 203 is integrally connected in terms of material via the transition section 400 to the press-in section 300.

The press-in section 300, optionally the transition section 400, the shoulder 203 and the shaft 201 are preferably arranged in the longitudinal direction L of the electrical press-in contact 1. It is here preferred that this longitudinal direction L corresponds to a force centerline of a press-in force F (see FIG. 5), so that a compressive force on the press-in contact 1 can easily be transmitted via the shoulder 203 onto the shaft 201. This means that the shaft 201 is provided in the press-in contact 1 such that the centerline thereof is substantially identical with the force centerline L of the press-in contact 1 or at least the force centerline L passes through the shaft 201. Preferably, the shaft 201 is oriented in parallel with the force center-line L.

The mounting section 100 formed as a solder base is substantially a plate bent out of the plane of the electrical press-in contact, which can clearly be seen in FIG. 3. Starting from the solder base formed as a plate, the mounting section 100 extends in longitudinal direction L of the press-in contact 1 (see FIGS. 4 and 5), and is then bifurcated into the shaft 201 and a transition section 104 branched off laterally from the shaft 201.

Integrally following the transition section 104, the compensating portion 210 is provided on the transition section 104. The shaft 201 extends in parallel with the compensating portion 201 and the compensating portion 201 terminates approximately at the level of the stop 221 of the shaft 201 at the mounting section side, and a transition section 204, which is provided on the compensating portion 201, integrally connects the compensating portion 201 to the shoulder 203. The shoulder 203 is part of the transition section 400 which passes into the press-in section 300.

Figure 6:
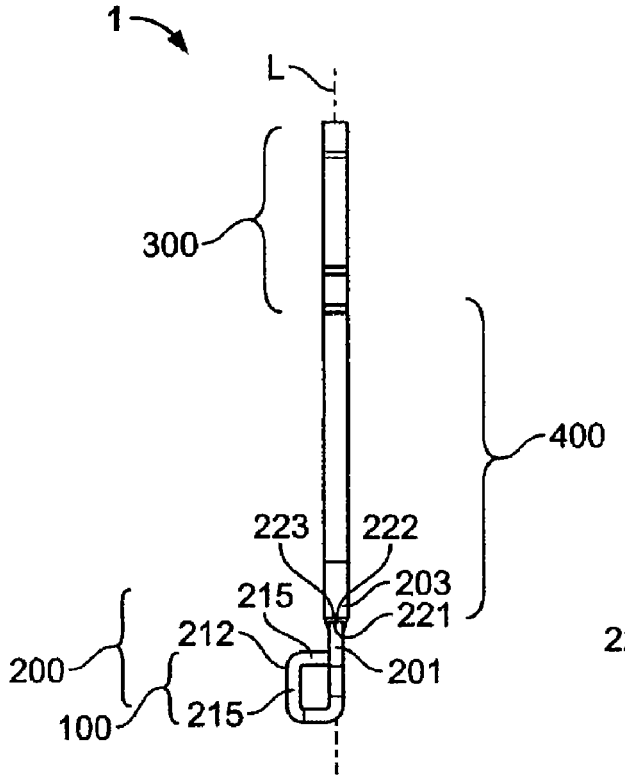
FIG. 6 is a side view showing a second embodiment of the press-in contact according to the invention in its inoperative position.
Figure 7:
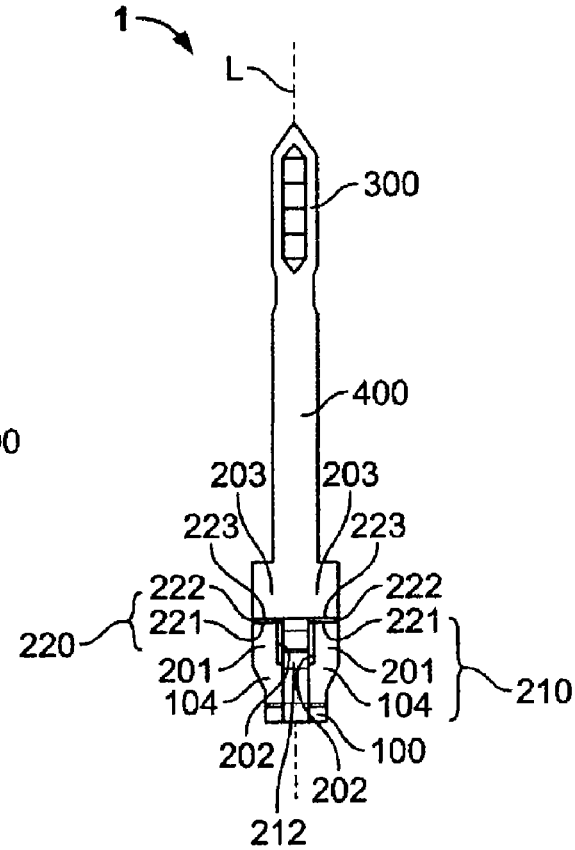
FIG. 7 is a top view on FIG. 6.
Figure 8:
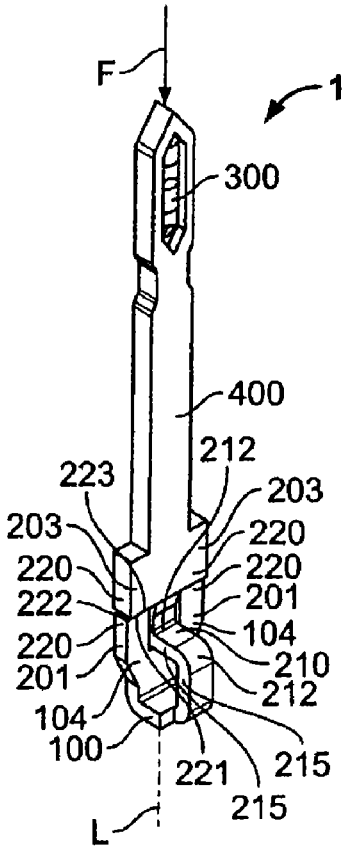
FIG. 8 is a perspective illustration of the second embodiment of the press-in contact according to the invention.

FIGS. 6 to 8 show a second embodiment of the electrical press-in contact 1 according to the invention, the relief section 200 being substantially shaped in a different way. The press-in contact 1 is here configured in symmetry with respect to the longitudinal direction L of the press-in contact 1 and, starting from the transition section 400, it has two shoulders 203 provided thereon, each of said shoulders having formed thereon a stop 223 at the press-in section side.

The two shoulders 203 are spaced apart from each other in transverse direction, and a section of the press-in contact 1 extends away thereinbetween downwards with respect to FIGS. 6 to 8, said section then forming a part of the compensating portion 210 of the press-in con-tact 1 via a compensating bend 212. The compensating portion 210 extends here out of the plane of the press-in contact 1 and is shaped in the form of an S when viewed from the side (see FIG. 8). The compensating portion 210 extends here in longitudinal direction L away from the press-in section 300 downwards and passes integrally into the mounting section 100, which is preferably configured as a solder base.

Like in the first embodiment of the invention, the mounting section 100 is again configured as a plate projecting out of the plane of the electrical press-in contact 1, a section of the press-in contact 1 being provided on each of the two opposing sides of the plate. At the one side of the plate the compensating portion 210 passes integrally into said plate and at the side opposite thereto the mounting section 100 is bifurcated by two transition sections 104 into two shafts 201, on the respective end of which a stop 221 at the mounting section side is provided and can cooperate with a respective stop 223 of the corresponding shoulder 203 at the press-in section side.

A section of the compensating portion 210 is provided between the two transition sections 104. In this embodiment of the invention at least the compensating portion 210 is again made preferably slightly thinner in its material thickness than the remaining electrical press-in contact 1, this can clearly be seen in FIG. 6.

In the two embodiments of the invention a maximum value can be set through a height of the slot 222 for the movement of the mounting section 100 and the press-in section 300 to-wards each other. The smaller the space is between the two, the less can the mounting section 100 and the press-in section 300 move towards each other. The slot 222 can at the most be given such a large size that the compensating portion 210 is just not damaged upon contact of the two stops 221, 223.

Figure 9:
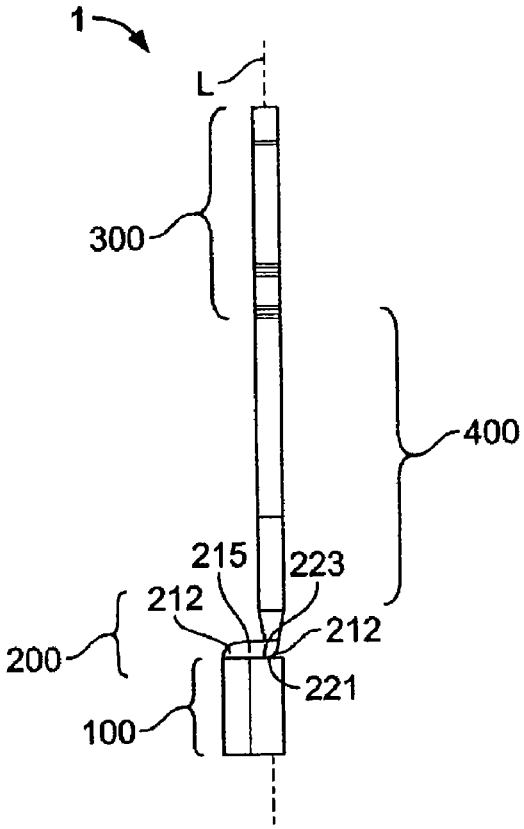
FIG. 9 is a side view showing a third embodiment of the press-in contact according to the invention in its inoperative position.
Figure 10:
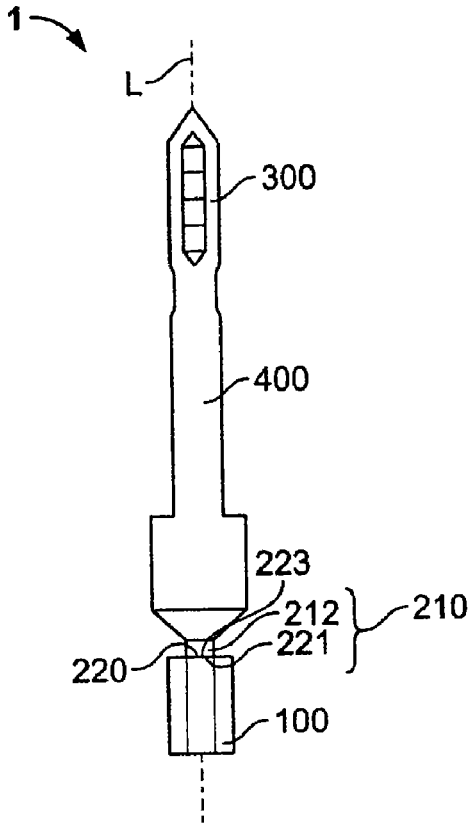
FIG. 10 is a top view on FIG. 9.
Figure 11:
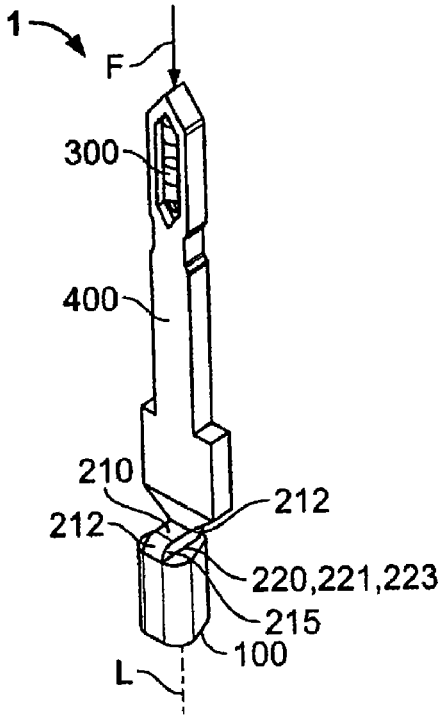
FIG. 11 is a perspective illustration of the third embodiment of the press-in contact according to the invention.

FIGS. 9 to 11 show a third embodiment of the electrical press-in contact 1 according to the invention, the compensating portion 210 and the stop portion 220 being no longer arranged in parallel as in the preceding embodiments, but in series. Here one side of the compensating portion 210 preferably forms a stop 221, 223 of the stop portion 220 at the same time.

In the present embodiment the mounting section 100, which is preferably formed as a solder base, is configured in the form of a block, and at one side of the mounting section 100 it passes with a plate into the compensating portion 210. The plate-shaped compensating portion 210 is here integrally connected via a compensating bend 212 to the mounting section 100 and at the opposite side it also passes via a compensating bend 212 integrally into the transition section 400 and finally into the press-in section 300.

The compensating portion 210 is now configured and provided within the electrical press-in contact 1 in such a way that it rests with a longitudinal side on a front side of the block-shaped mounting section 100. This means that no gap is provided between the compensating portion 210 located on the mounting section 100 and the mounting section 100.

The side with which the compensating portion 210 rests on the mounting section 100 simultaneously forms the stop 223 of the stop portion 220 at the press-in section side, whereas the side of the mounting section 100 that is opposite the compensating portion 210 forms the stop 221 at the mounting section side. This means that in the illustrated inoperative position of the press-in contact 1 the stop portion 220 substantially comprises the two stops 221, 223 formed on the compensating portion 210 and the mounting section 100, respectively.

According to this embodiment of the invention a press-in force F is directly introduced via the compensating bend 212 and the compensating portion 201, via its stop 223 at the press-in section side into the stop 221 at the mounting section side and from there into the mounting section 100. By contrast, if a force is exerted in a direction opposite to said direction, the stop 223 at the press-in section side can lift off from the stop 221 at the mounting section side and thereby provide longitudinal compensation for the press-in section 300 and the mounting section 100.

In all embodiments of the invention it is preferred that the relevant sections of the electrical press-in contact 1 that transmit the press-in force F are made as stiff as possible. In the first two embodiments of the invention, this specifically concerns the shaft(s) 201 and the shoulder(s) 203. According to the invention an independent blocking of the press-in contact 1 is accomplished that provides a blocking or inhibiting action without any additional components or component sections.

Figure 12:
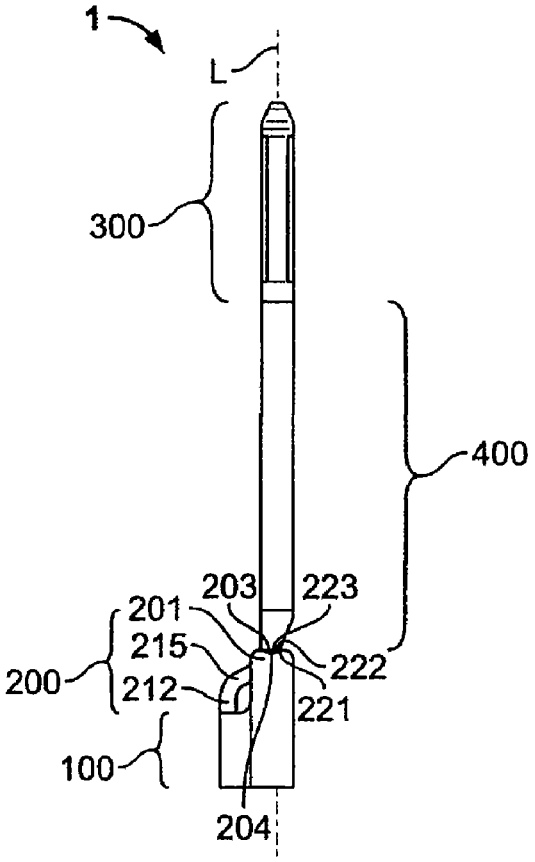
FIG. 12 is a side view showing a fourth embodiment of the press-in contact according to the invention in its inoperative position.
Figure 13:
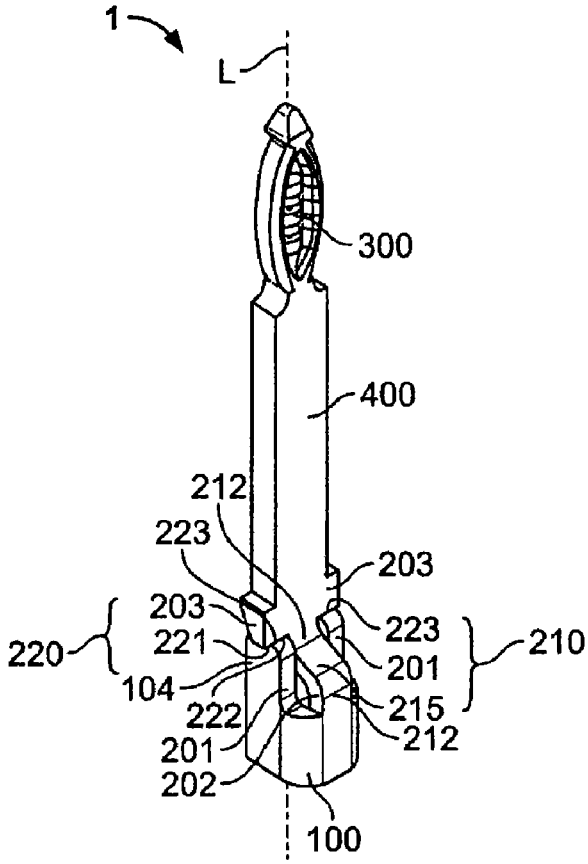
FIG. 13 is a perspective illustration of the fourth embodiment of the press-in contact according to the invention from the front.
Figure 14:
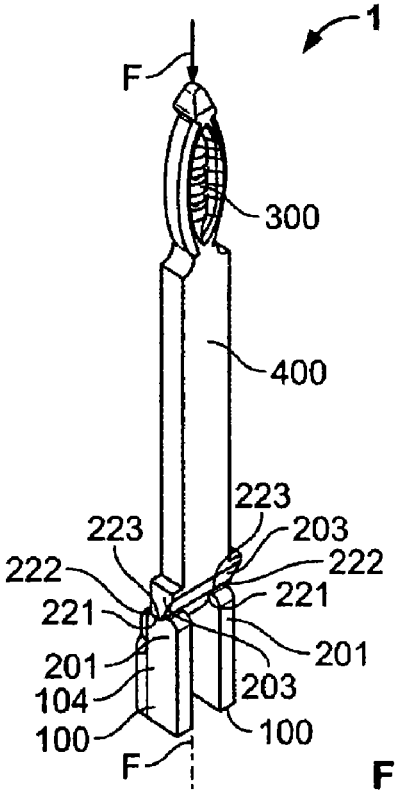
FIG. 14 is a perspective illustration of FIG. 13 from the rear.

FIGS. 12 to 14 show a fourth embodiment of the electrical press-in contact 1 according to the invention, the press-in contact 1 being similar to the second embodiment of the press-in con-tact 1. Thus the observations made on the second embodiment shall also be applicable to the fourth embodiment. One difference between the second and fourth embodiment of the invention is substantially the different shape of the mounting section 100 and the compensating portion 210 as well as the stop portion 220.

In the present embodiment the mounting section 100 in plan view has the shape of a U, which substantially grows linearly upwards into a third dimension, whereby the electrical press-in contact 1 is shaped like a tub in a lower section (with reference to FIG. 14). Starting from a certain height, this tub is slotted (slots 202), the slots 202 being each arranged in a transition portion from a respective leg to the web of the U and growing upwards up to a longitudinal end of the tub.

The compensating web 215 (web of the U-shaped plan view) as well as two shafts 201 (legs of the U-shaped plan view) that are opposite each other substantially in parallel are formed by the two slots 202 from the tub. The compensating web 215 of the compensating portion 210 has substantially the form of an S when viewed from the side (see FIG. 13), the compensating web 215 comprising two compensating bends 212 on its longitudinal ends, by means of which the compensating web 215 passes on the one hand into the mounting section 100 and on the other hand into the transition section 400 and the press-in section 300, respectively.

The compensating web 215 extends towards a center portion of the shafts 201, which are arranged substantially vertically thereto, and is here guided at an angle, preferably a 45° angle, relative to the longitudinal axis L between the mounting section 100 and the remaining electrical press-in contact 1. This means that the compensating web 215 shifts the transition section 400 and the press-in section 300, respectively, relative to a side wall (web of the U-shaped plan view) of the tub-shaped mounting section 100 further inwards into the press-in contact 1.

The shafts 201 that are substantially opposite to and parallel with each other with their large sides and could also be called walls face a respective shoulder 203 of the stop portion 220 in the longitudinal direction L of the electrical press-in contact 1, whereby a stable arrangement is created that is also well suited for thin stamped metal sheets. The respective free longitudinal ends of the shafts 201, in turn, form a respective stop 221 at the mounting section side, and the respective free longitudinal end of the shoulders 203 forms a respective stop 223 at the press-in section side. The two stops 221, 223 can again rest on each other in the inoperative position of the press-in contact 1 or may be spaced apart from each other by way of a slot 222.

According to the invention the respective shaft 201 and/or the respective shoulder 203 may comprise a recess 104. In the embodiment of the invention as shown in FIGS. 12 to 14, there is however only one recess 104 in the respective shoulder 203, which can best be seen in FIG. 12. When the press-in contact 1 is pressed in, this enables a safe seat of the respective shoulder 203 on the corresponding shaft 201 because this yields a kind of centering of the shoulder 203 on the shaft 201.

It is preferred according to the invention that the electrical press-in contact 1 is tapering in its wall thickness in a section of the shoulders 203, so that the underlying section of the press-in contact 1 is made thinner. The tapering form of the wall thickness is preferably completed at the latest on the free end of the respective shoulder 203 that has provided thereon the stop 223 of the respective shoulder 203 at the press-in section side. This makes it easier to center the shoulder in the recess 204 and yields a reduced spring constant of the compensating portion 210.

The invention claimed is:

1. An electrical press-in contact, particularly a press-in pin contact, for transmitting electric current and/or electrical signals, comprising a press-in section and a mounting section which are mechanically coupled with each other via a relief section, and the relief section comprises a compensating portion and a stop portion, wherein the compensating portion and the stop portion allow a coupled relative movement of the press-in section and of the mounting section, and the stop portion blocks a movement of the press-in section and the mounting section towards each other, and wherein the stop portion of the relief section is arranged substantially in symmetry with a longitudinal axis of the press-in section, along which a press-in force is introducible into the electrical press-in contact that results from a pressing of the electrical press-in contact into a carrier.

2. The electrical press-in contact according to claim 1, wherein the compensating portion and the stop portion are arranged in parallel or in series with each other in the relief section of the electrical press-in contact.

3. The electrical press-in contact according to claim 1, wherein the stop portion of the relief section comprises a stop at the press-in section side and a stop at the mounting section side, wherein the two stops cooperatingly block the movement of press-in section and mounting section towards each other.

4. The electrical press-in contact according to claim 3, wherein in an inoperative position of the electrical press-in contact a slot or a gap is provided between the stop at the press-in section side and the stop at the mounting section side.

5. The electrical press-in contact according to claim 3, wherein in an inoperative position of the electrical press-in contact the stop at the press-in section side rests on the stop at the mounting section side.

6. The electrical press-in contact according to claim 1, wherein the compensating portion of the relief section comprises at least one compensating bend and/or a compensating web for a longitudinal compensation between the press-in section and the mounting section.

7. The electrical press-in contact according to claim 3, wherein in an inoperative position of the electrical press-in contact a slot or a gap is provided between the stop at the press-in section side and the stop at the mounting section side, the relief section comprises a shaft on the free end of which the stop at the mounting section side is provided, the relief section comprises a shoulder on which the stop at the press-in section side is provided and the slot or gap is provided between the free end of the shaft and the shoulder.

8. The electrical press-in contact according to claim 3, wherein the relief section comprises a shaft on the free end of which the stop at the mounting section side is provided, the relief section comprises a shoulder on which the stop at the press-in section side is provided and the shaft and/or the shoulder comprises a recess in which or by which the shoulder can be centered while the press-in contact is pressed in.

9. The electrical press-in contact according to claim 1, comprising a single shaft arranged substantially in symmetry with respect to the force centerline and a compensating portion arranged in asymmetry with respect to the force centerline.

10. The electrical press-in contact according to claim 1, comprising two shafts which are substantially arranged in symmetry with each other relative to the force centerline and between which the compensating portion of the relief section passes into the press-in section of the electrical press-in contact.

11. The electrical press-in contact according to claim 3, wherein the compensating portion of the relief section comprises at least one compensating bend and/or a compensating web for a longitudinal compensation between the press-in section and the mounting section and the relief section is composed of the stop at the mounting section side and the compensating web of the compensating portion, wherein a longitudinal side of the compensating web forms the stop of the stop portion at the press-in section side and the compensating web is provided for longitudinal compensation between the press-in section and the mounting section.

12. The electrical press-in contact according to claim 1, wherein the compensating portion of the relief section comprises at least one compensating bend and/or a compensating web for a longitudinal compensation between the press-in section and the mounting section and in the inoperative position of the press-in contact the compensating web projects substantially at a right angle from the press-in section and is provided substantially in parallel relative to the stop at the mounting section side in the electrical press-in contact.

13. The electrical press-in contact according to claim 1, wherein the compensating portion and the stop portion are integrally formed with each other in terms of material.

14. The electrical press-in contact according to claim 1, wherein the press-in section and the relief section and/or the mounting section and the relief section are integrally formed with one another in terms of material.

15. The electrical press-in contact according to claim 3, wherein the relief section comprises a shaft on the free end of which the stop at the mounting section side is provided, and the compensating portion of the electrical press-in contact is provided substantially spaced-apart in parallel with the shaft of the relief section.

16. The electrical press-in contact according to claim 15, wherein the shaft and the compensating portion of the relief section pass into the mounting section of the electrical press-in contact.

17. The electrical press-in contact according to claim 3, wherein the relief section comprises a shoulder on which the stop at the press-in section side is provided.

18. The electrical press-in contact according to claim 17, wherein the shoulder and the compensating portion of the relief section pass into the press-in section of the electrical press-in contact.

19. An electrical or electronic module or printed circuit board comprising an electrical press-in contact, particularly a press-in pin contact, for transmitting electric current and/or electrical signals, said press-in contact comprising a press-in section and a mounting section which are mechanically coupled with each other via a relief section, and the relief section comprises a compensating portion and a stop portion, wherein the compensating portion allows a coupled relative movement of the press-in section and of the mounting section, and the stop portion blocks a movement of press-in section and mounting section towards each other, and wherein the stop portion of the relief section is arranged substantially in symmetry with a longitudinal axis of the press-in section, along which a press-in force is introducible into the electrical press-in contact that results from a pressing of the electrical press-in contact into a carrier.

20. The electrical press-in contact according to claim 1, wherein the stop portion includes a first stop and a second stop on opposite sides of the longitudinal axis.

* * * * *